US007182549B2

(12) United States Patent
Wiker

(10) Patent No.: US 7,182,549 B2
(45) Date of Patent: Feb. 27, 2007

(54) METHOD AND DEVICE FOR LEVELING OF A SURFACE

(76) Inventor: Omar Wiker, Våler Gård, N-2080, Eidsvoll (NO)

( * ) Notice: Subject to any disclaimer, the term of this patent is extended or adjusted under 35 U.S.C. 154(b) by 0 days.

(21) Appl. No.: 10/490,800

(22) PCT Filed: Oct. 1, 2002

(86) PCT No.: PCT/NO02/00350

§ 371 (c)(1),
(2), (4) Date: Sep. 27, 2004

(87) PCT Pub. No.: WO03/029561

PCT Pub. Date: Apr. 10, 2003

(65) Prior Publication Data

US 2006/0275079 A1 Dec. 7, 2006

(51) Int. Cl.
*E01C 19/12* (2006.01)
*E01C 19/15* (2006.01)

(52) U.S. Cl. ..... 404/110; 404/101; 404/102; 404/105; 404/108

(58) Field of Classification Search ..... 404/118, 404/101, 102, 84.5, 108, 105, 110; 356/612, 356/613
See application file for complete search history.

(56) References Cited

U.S. PATENT DOCUMENTS

| | | | | |
|---|---|---|---|---|
| 2,092,458 A | | 9/1937 | Krout | |
| 3,403,609 A | * | 10/1968 | Bradshaw et al. | 404/105 |
| 3,891,338 A | * | 6/1975 | Smith et al. | 404/84.1 |
| 3,901,616 A | * | 8/1975 | Greening | 404/102 |
| 3,907,451 A | * | 9/1975 | Fisher et al. | 404/101 |
| 3,909,146 A | * | 9/1975 | Hoffman | 404/110 |
| 4,379,653 A | * | 4/1983 | Brown | 404/118 |
| 4,765,772 A | * | 8/1988 | Benedetti et al. | 404/77 |
| 4,842,441 A | * | 6/1989 | Watkins | 404/98 |
| 5,232,305 A | * | 8/1993 | Bassett et al. | 404/101 |
| 5,868,522 A | * | 2/1999 | Campbell | 404/114 |
| 6,050,744 A | | 4/2000 | Binning | |
| 6,171,018 B1 | * | 1/2001 | Ohtomo et al. | 404/84.5 |
| 6,398,453 B1 | * | 6/2002 | Stegemoeller | 404/108 |

FOREIGN PATENT DOCUMENTS

| | | |
|---|---|---|
| EP | 0 364 129 | 9/1989 |
| GB | 2 226 839 | 1/1989 |
| WO | WO 00/61870 | 10/2000 |

* cited by examiner

*Primary Examiner*—Raymond Addie
(74) *Attorney, Agent, or Firm*—Knobbe, Martens, Olson & Bear, LLP

(57) ABSTRACT

The invention relates to a method for smoothing or leveling a ground surface, wherein a smoothing or leveling material is laid on a ground surface in that a box-like device filled with material is moved forwards, the material being allowed to exit a plate-adjustable rear opening in the box-like device and to come to lie in a strip, and a blade mounted on the box-like device after the opening spreads the material on the ground surface, the blade being capable of being raised and lowered together with the plate, the blade is raised and lowered with an adjustable reduction ratio relative to the plate, by means of a lever/parallelogram arrangement which connects the blade and the plate.

34 Claims, 9 Drawing Sheets

METHOD AND DEVICE FOR LEVELING OF A SURFACE

CLAIM OF PRIORITY

This application is the U.S. National Phase of PCT/NO02/00350 filed Oct. 1, 2002 and claims priority to Norwegian Patent Application No. 200114763 filed Oct. 1, 2001, which are hereby incorporated herein by reference in their entirety.

BACKGROUND OF THE INVENTION

1. Field of the Invention

The invention relates to a method for leveling a ground surface.

2. Description of the Related Art

It is known (GB 2226839) to use a box at the rear end of which there is a plate-adjustable opening for the discharge of material as the box is moved forwards on the ground surface. In a known box of this kind, it is also known to raise and lower the plate so as to regulate the amount of material that exits through the opening as the box is moved forwards. Mounted behind the plate is a blade which can be raised and lowered relative to the plate.

SUMMARY OF THE INVENTION

The invention relates to a method for levelling a ground surface wherein material is laid on the ground surface in that a box-like device filled with levelling material is moved forwards, the levelling material being allowed to exit through a plate-adjustable rear opening in the box-like device and to come to lie in a strip, and a blade mounted on the box-like device after the opening spreads the material on the ground surface, the blade being capable of being raised and lowered with the plate.

The invention also relates to an apparatus for levelling a ground surface, comprising a box-like device which has two side walls and a front and a rear end wall, where the rear end wall has an opening at the bottom, with a plate in the opening that can be raised and lowered to regulate the amount of material that exits through the opening as the box filled with levelling material is moved forwards, and with a blade or plough behind the plate and mounted so as to be capable of being raised and lowered together with the plate.

The object of the invention is to permit an accurate and desirable spreading and levelling of the levelling material or smoothing material in order to provide an optimally levelled ground surface for elements that set stringent requirements as regards precise location. Examples of such elements are railway cable pits, water pipes, drop pipes, cables etc.

Other areas of use may be the smoothing of footpaths/cycle tracks, pavements and the laying of kerbstones and bedding for flagstones and paving stones.

One particular object is to allow spreading and levelling of a material in areas of restricted space where it would be difficult to work with huge machines, e.g., road graders and the like, and it is also a particular object to provide an apparatus that is highly suitable for spreading and levelling material on such areas of restricted space.

A particular object of the invention is to permit the laying of a smoothing or levelling material in a desired width using one and the same box-like device.

Another particular object of the invention is to make possible an apparatus which in a simple manner can be altered to give the box-like device greater width, or can be made narrower.

According to the invention, the basic idea is that a certain amount of smoothing material will flow out through the plate-adjustable opening as the box-like device is moved forwards on the ground surface that is to be smoothed or levelled. The blade at the back is used to spread the smoothing material out to the desired width, equal to or greater than the width of the box (box opening).

According to the invention a method as set forth in claim 1 is therefore proposed.

It is especially advantageous if the height of the blade is registered by a levelling system, in particular a laser system, and registered deviation from a set value is compensated by raising/lowering the plate and thus the blade until the levelling system registers/indicates the correct blade height.

According to the invention an apparatus according to claim 3 is also proposed.

The adjustable reduction ratio can be obtained in many ways, e.g., by a gear coupling, but it advantageous for the apparatus to be constructed so that the blade and the plate are mutually interconnected to a lever arrangement where the blade is adjustably mounted on a lever.

It is particularly advantageous for the blade to be supported so as to be adjustably mounted in a parallelogram arrangement where the lever and the blade supporting part form a respective parallelogram side.

For levelling, the blade can be fixedly connected to a laser reflector.

BRIEF DESCRIPTION OF THE DRAWINGS

The invention will now be described in more detail with reference to the drawings, wherein.

DETAILED DESCRIPTION OF THE PREFERRED EMBODIMENT

Figure 1:
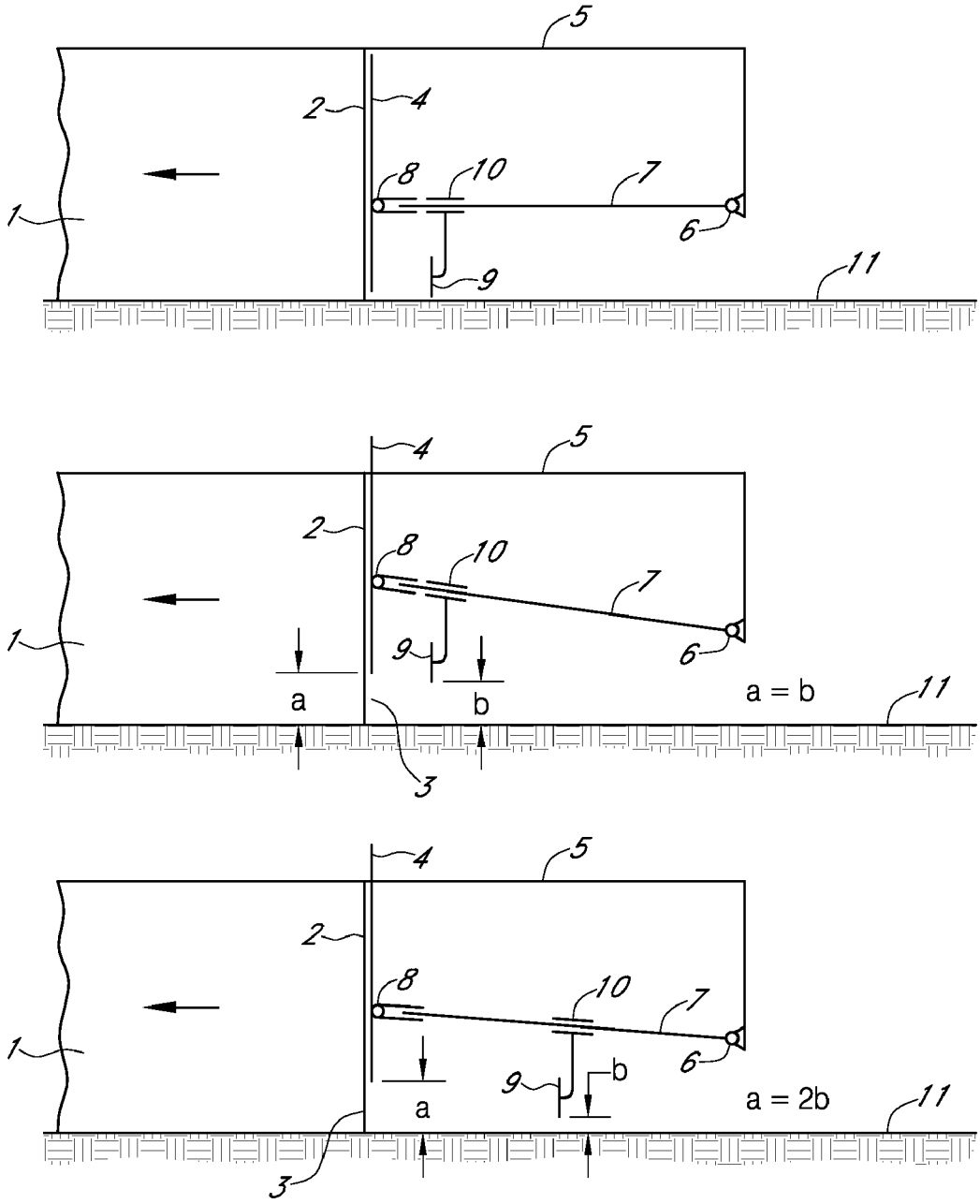
FIG. 1 is a purely schematic illustration of how the apparatus may be constructed, the figure showing three different settings between the plate and the blade.
Figure 3:
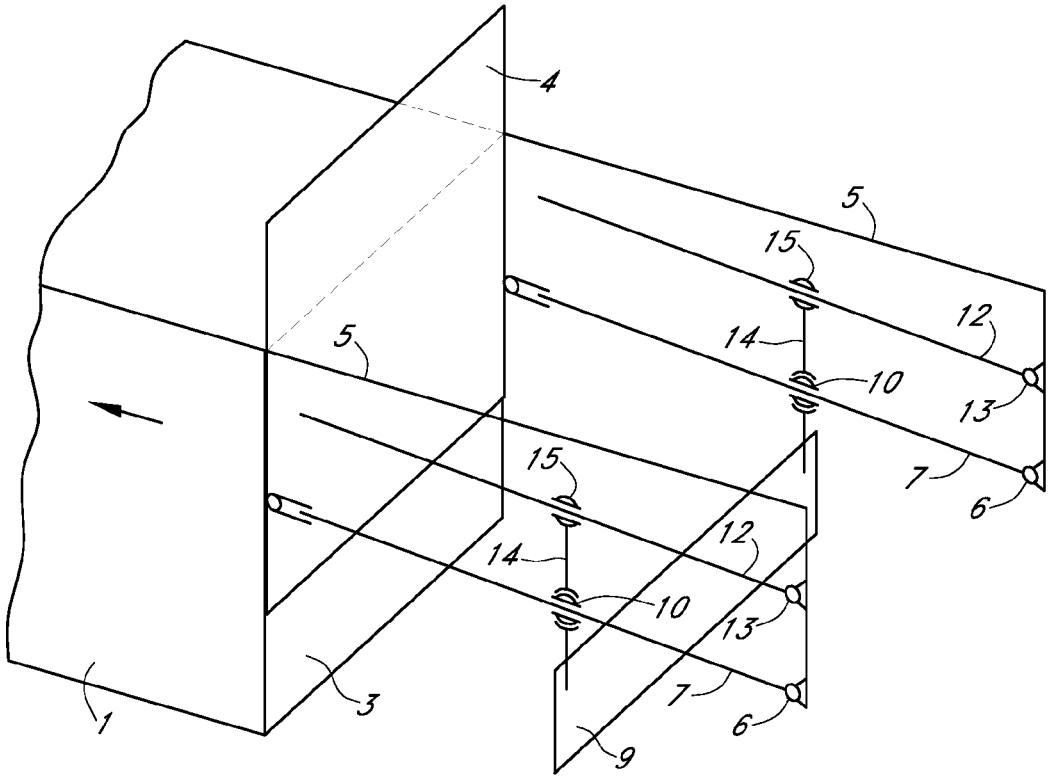
FIG. 3 is a schematic perspective view of the embodiment in FIG. 2.

FIG. 1 shows a box-like device 1, see also FIG. 3, where in a rear end wall 2 there is an opening 3 the exit area of which can be adjusted by means of a plate 4 that is capable of being raised and lowered. The end wall 2 is the rear wall of the box 1 because during smoothing or levelling the box is moved in the direction of the arrow (to the left on the drawings).

The plate 4 can be raised and lowered by using non-illustrated means, for example, one or more hydraulic working cylinders. This will be shown and discussed in more detail below in connection with FIGS. 4–7.

One (or for example two) supporting arms 5 project backwards from the box 1. As shown, the supporting arm 5 is angular and forms an articulated support 6 for a rod 7 the other end of which is articulately supported on the plate 4 at 8. At the articulated support 8 there is indicated a certain scope for telescopic movement to compensate for changes in length when the plate 4 is moved up and down, thereby swinging the rod 7 in the vertical plane about the articulated support 6 on the arm 5. In some cases the joints 6 and 8 could be made so slack that this in itself would provide the necessary length compensation.

The rod 7 supports a blade 9. The blade 9 is supported by the rod 7 via a sleeve 10 that can be moved on the rod 7 in the longitudinal direction of the rod and fixed at a desired point on the rod, continuously or optionally in steps (locking pin holes).

In the top illustration and in the centre illustration of FIG. 1, the blade 9, i.e., the supporting sleeve 10, is placed close to the joint 8 and thus close to the blade 4. At the top in FIG. 1 the plate 4 is shown in a lowered position, i.e., in a position in which it blocks the opening 2. The blade 9 is at the same level as the lower edge of the plate 4. When the plate 4 is raised a distance a, as shown in the centre illustration of FIG. 1, the blade 9 will also be raised, but depending on the distance between the sleeve 10 and the joint 8, the length b that the blade is lifted will differ from the lifting length a of the plate. This is due to the leverage that is provided between the plate and the blade.

In the bottom illustration in FIG. 1 the blade 9 is shown displaced to about the middle of the rod 7 and fixed in that position. It can be seen that when the plate 4 is lifted a distance a, the blade 9 will only be lifted a distance b which corresponds to half the lifting distance a of the plate.

Thus, by moving the blade 9 along the rod 7, it is possible to set a reduction ratio between the plate 4 and the blade 9. This means that in, for example, the setting shown at the bottom of FIG. 1, smoothing material will flow out through the discharge opening 3 when the box 1 is moved forwards in the direction of the arrow, and this material will be spread out in a larger width by the blade 9, as determined by the setting between the movement of the plate and the movement of the blade. Of course, the blade 9 is made having a width corresponding to the width that is to be laid, and which thus is larger than the width defined by the box 1.

Using one and the same box 1 it is thus possible to lay different, desired widths of smoothing or levelling material on a ground surface 11 on which the box 1 is advanced.

Figure 2:
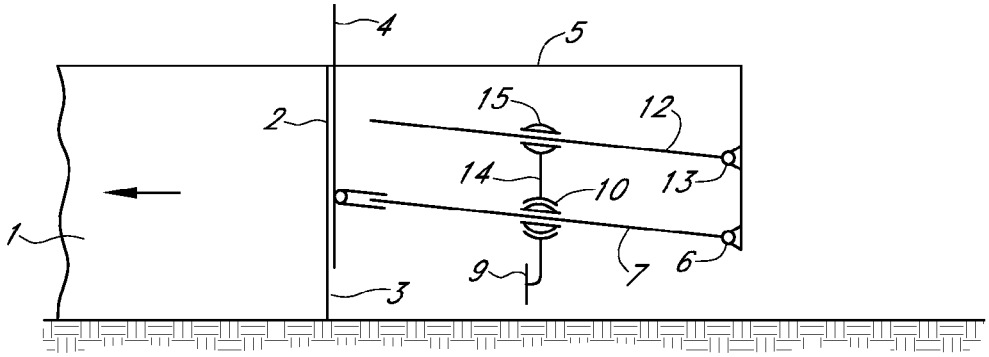
FIG. 2 is a purely schematic illustration of a parallelogram embodiment for blade suspension.

To obtain a parallel displacement of the blade 9, the parallelogram solution shown in FIG. 2, see also FIG. 3, may optionally be used. In FIG. 2 a parallel rod 12 is arranged parallel to the rod 7 and is articulately supported in the supporting arm 5 at 13. The blade 9 is attached to a rod 14 that is pivotally connected to a respective sleeve 10, 15 which can be moved along the rod 7 and the parallel rod 12 respectively and fixed there in the same way as discussed earlier.

FIG. 3 is a purely schematic illustration of an advantageous embodiment in which two parallel supporting arms 5 are used. A construction of this kind is particularly advantageous because the whole apparatus can thereby be made symmetrical about the longitudinal axis of the box. By changing the transverse dimension of the box, i.e., by changing the non-illustrated front wall of the box and the rear end wall of the box with the plate 4, the width of the box can be changed, keeping the supporting arms 5 and the equipment suspended thereby.

Figure 4:
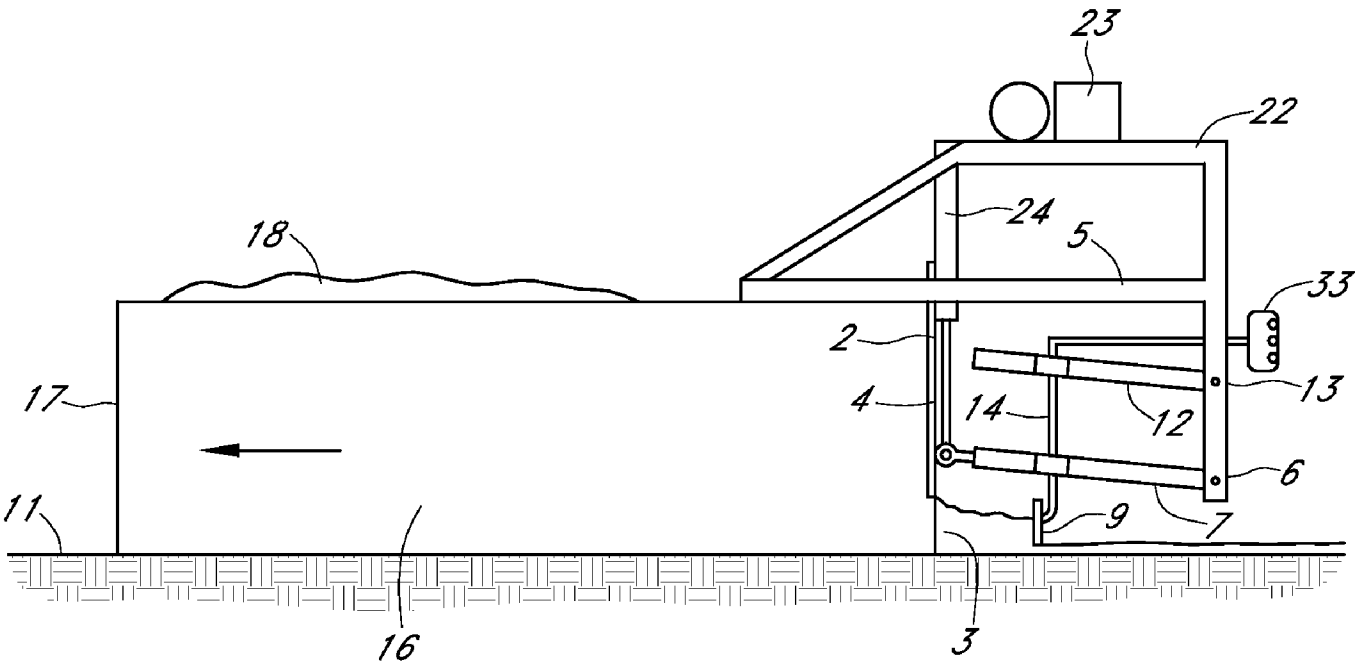
FIG. 4 is a side view of a practical embodiment of an apparatus according to the invention.
Figure 5:
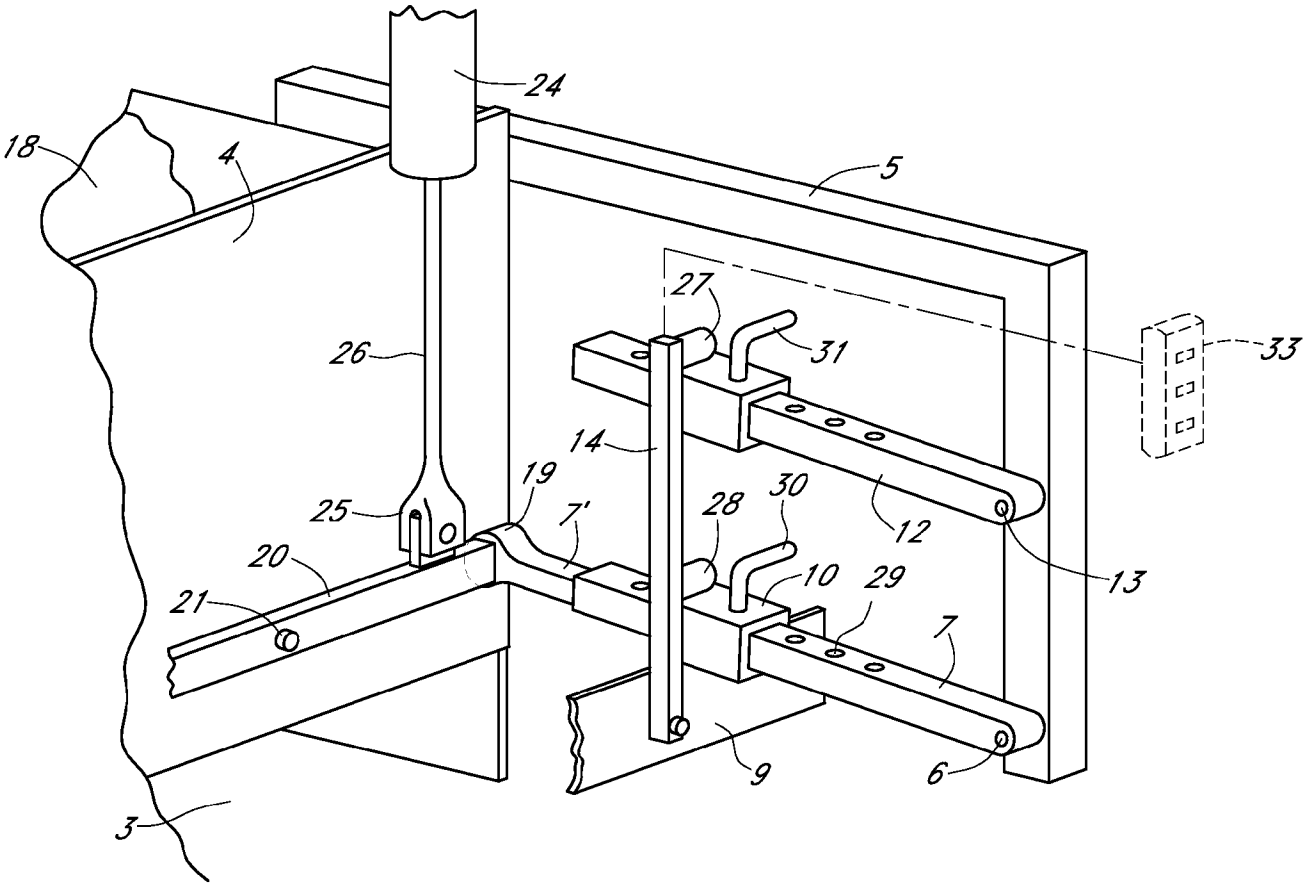
FIG. 5 is an enlarged detail section from the embodiment in FIG. 4.
Figure 6:
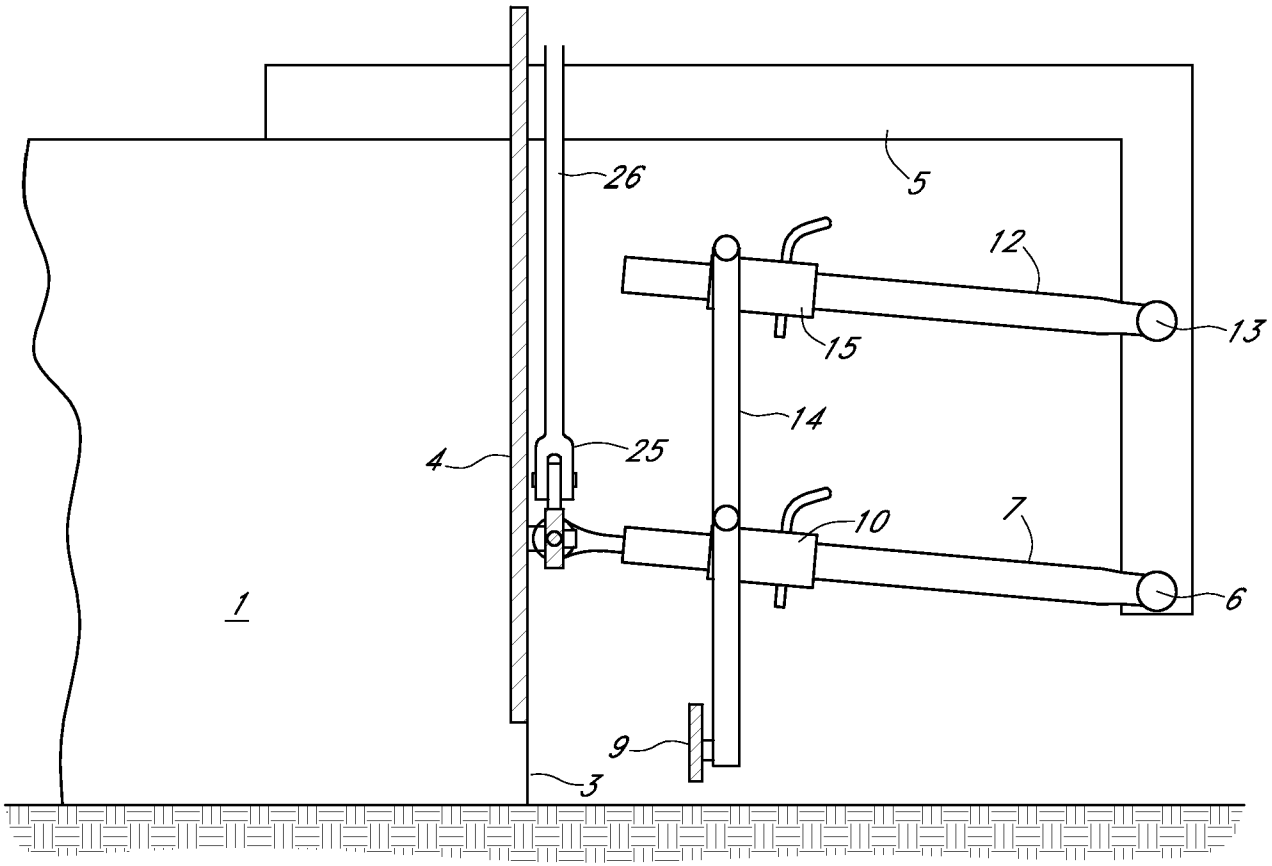
FIG. 6 is a side view of the detail section in FIG. 5.

From a purely practical point of view, the apparatus according to the invention can, for example, be made as shown in FIGS. 4–6. The apparatus shown in FIGS. 4–6 is a leveller comprising a box-like device which has two side walls 16 (only one side wall is shown in FIG. 4), a front end wall 17 and a back end wall 2 (the same reference numerals are used here as in the schematic FIGS. 1–3).

A smoothing material 18 is placed in the box-like device 1. The box-like device 1 may optionally be bottomless, or have a partial bottom or a complete bottom (not shown). The longitudinal side walls 16 are optionally braced by non-illustrated transverse bars.

The rear end wall 2 has an opening that extends upwards from the bottom edge and whose discharge opening 3, as previously mentioned, can be adjusted by means of a plate 4 that is capable of being raised and lowered. In FIG. 5 a levelling material 18 is indicated in the box 1, but for clarity, the material has been omitted in the bottom part of FIG. 5, i.e., the area close to the discharge opening 3 and the blade 9.

Two parallel supporting arms 5 are welded in place at the top of the box 1, i.e., that the illustrated practical embodiment is made in the same way as the basic embodiment shown in FIG. 3. A rod 7 is supported in each supporting arm 5.

As shown in FIGS. 5 and 6 each rod 7 is telescopic, and in the exemplary embodiment the rod consists of a rectangular tube that is supported in the supporting arm 5 at 6 and accommodates a rectangular rod 7'. The rod 7, 7' is articulately connected at 19 to a lever arm 20 which in the middle is tiltably supported in the plate 4 by means of a swing bolt 21.

Above the supporting arms 5 there is provided a platform structure 22 on which necessary hydraulic equipment 23 for working cylinders 24 is placed. Two working cylinders 24 are shown in the exemplary embodiment. As shown in FIG. 5, a working cylinder 24 is found at one end of the lever arm and is connected to the lever arm by means of a yoke 25 formed on the end of the working cylinder piston rod 26. A similar working cylinder with piston rod is arranged at the other end of the lever arm 20, next to the other supporting arm 5.

When the working cylinders 24 are actuated, they will work opposite one another and cause a swinging or tilting of the lever arm 20. Thus, the articulated connection 19 of the arm 7, 7' is moved up and down, and the two supporting arms 7 are then swivelled correspondingly about their respective articulated support 6. In this way, the blade 9 can be tilted or adjusted to compensate for irregularities.

Actuation of both working cylinders 24 in the same direction will allow the plate 4 to be raised and lowered. Of course, the pivot point 21 of the lever arms 20 is thus also raised and lowered, and the two arms 7,7' are also moved correspondingly in their respective vertical planes.

The blade 9 is suspended from two rods 14 (only one is shown). The rod 14 is articulately connected at 28 and 27 to respectively a sleeve 10 and a sleeve 15 which are slidably arranged on the rod 7 and the parallel rod 12 respectively. In the rod 7 and the parallel rod 12 there are locking pin holes 29, designed for cooperation with a respective locking pin 30, 31 in the sleeve 10 and 15 respectively. In this way, the sleeve 10 and 15 can be moved on the respective rod 7, 12 and fixed step by step in accordance with the holes 29.

Figure 7:
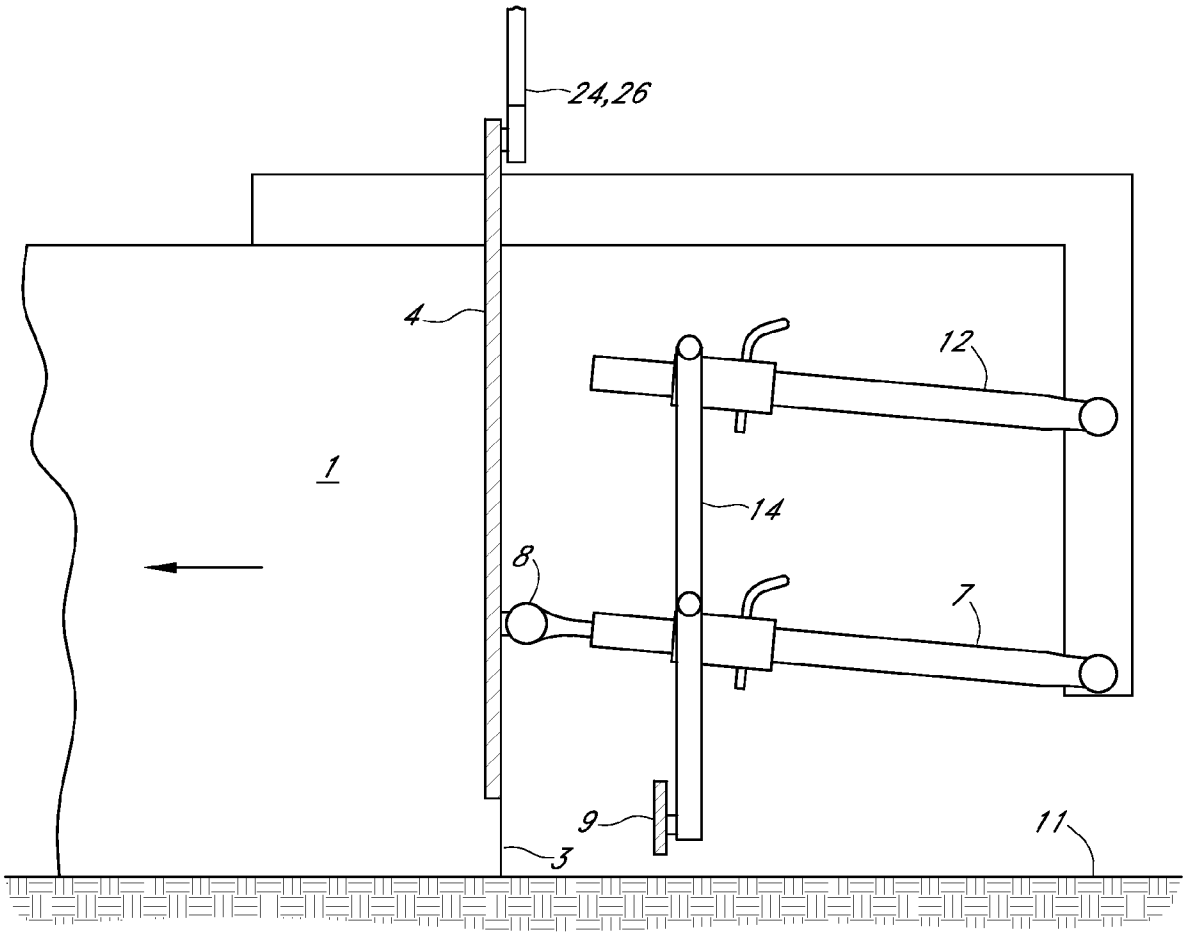
FIG. 7 is a side view like that in FIG. 6 of a modified embodiment.

FIG. 7 shows a modified embodiment, where the working cylinders 24, 26 are connected directly to the plate 4 and where the two parallel rods 7 are articulately connected directly to the plate 6 as indicated by 8.

For smoothing or levelling, the box 1 is moved in the direction of the arrow. The smoothing material 18 will flow out through the discharge opening 3 and will be spread by the following blade 9 in a width larger than the width of the discharge opening 3 and which is determined by the leverage between plate 4 and blade 9.

Advantageously, the blade 9 can be connected to a levelling system, in FIGS. 4 and 5 indicated as a laser reflector 33. Laser beams are sent from an installed laser transmitter to the reflector 33, and deviation from the desired levelling will be detected and signalled to a suitable device which will cause the working cylinder or the working cylinders 24, 26 to be actuated in a desired direction and distance.

Figure 8:
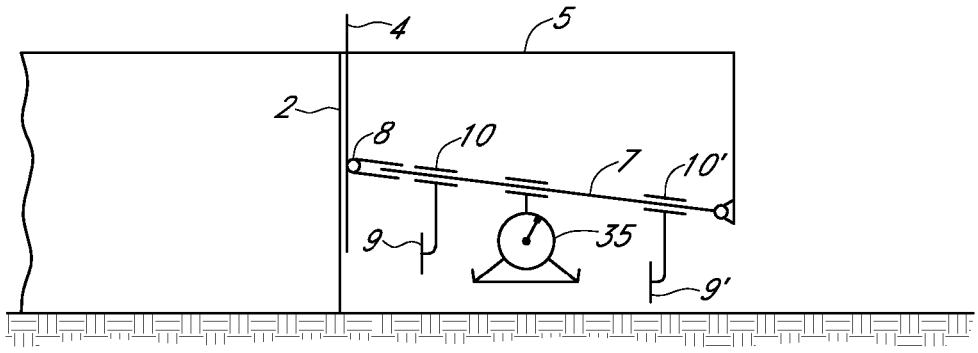
FIG. 8 is a purely schematic illustration of a variant.

FIG. 8 shows a variant with two blades 9, 9' arranged one after the other and at a different height above the ground. A compactor 35 is suspended from the bar 7 between the two blades 9, 9'.

Figure 9:
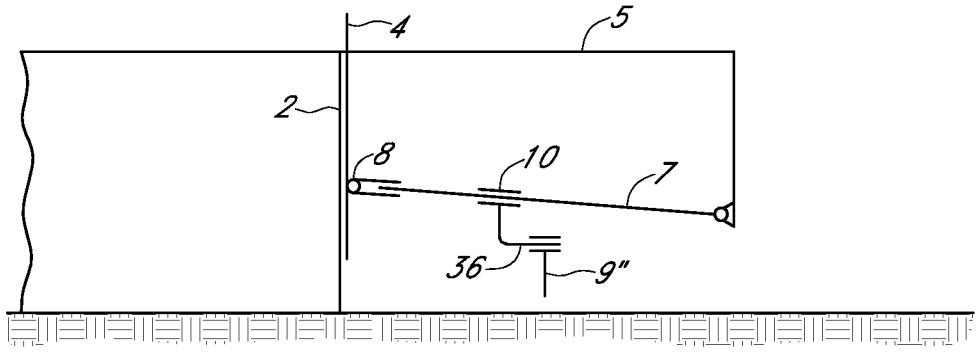
FIG. 9 is a purely schematic illustration of another variant.

FIG. 9 shows a variant where the blade 9" is slidingly suspended on a bent bar 36. In an embodiment of this kind the blade can be tilted in the horizontal plane.

Figure 10:
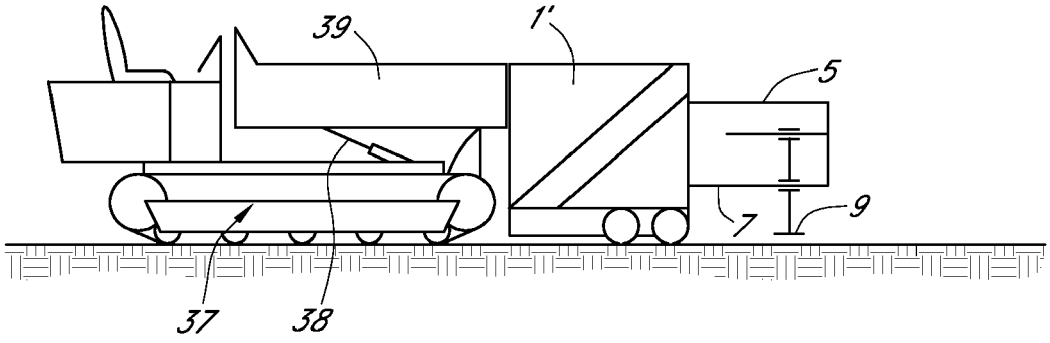
FIG. 10 shows a possible variant of the invention.
Figure 11:
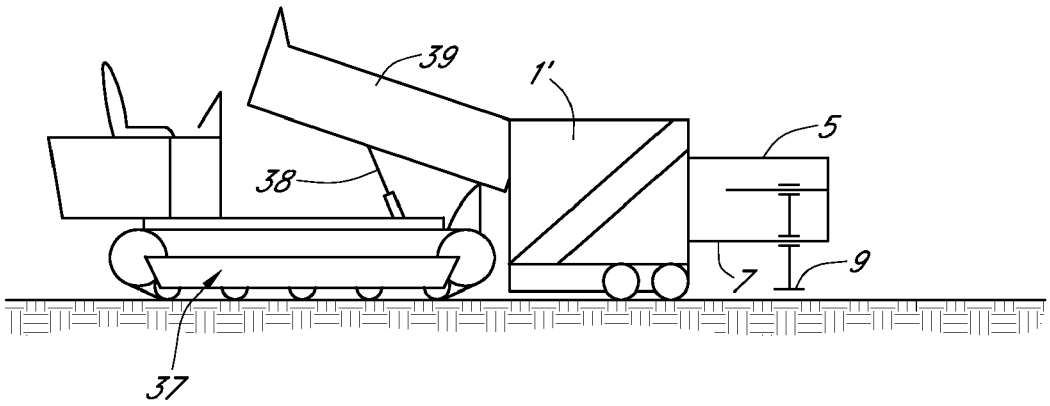
FIG. 11 shows the embodiment in FIG. 10 in a position for refilling the box with material.

FIGS. 10 and 11 show an embodiment in which a box 1' is towed by a small crawler 37 which includes a loading box 9 tiltable by working cylinder 38. The loading box 39 contains material, which can be transferred to the box 1' by tilting (FIG. 11) the loading box.

The new apparatus according to the invention permits a rapid and accurate smoothing/levelling. The apparatus can be towed or can be self-propelled, for example with crawler belts.

The apparatus can optionally be provided with a device (not shown) for laying sheeting or the like, before or after the levelling operation.

In the exemplary embodiments it is shown that the plate is raised and lowered by suitable means, preferably one or two hydraulic working cylinders. A person skilled in the art would know that the working cylinder/cylinders could instead act on the levers/rods 7 or on the parallel rods 13, and thus act indirectly on the plate.

Figure 12:
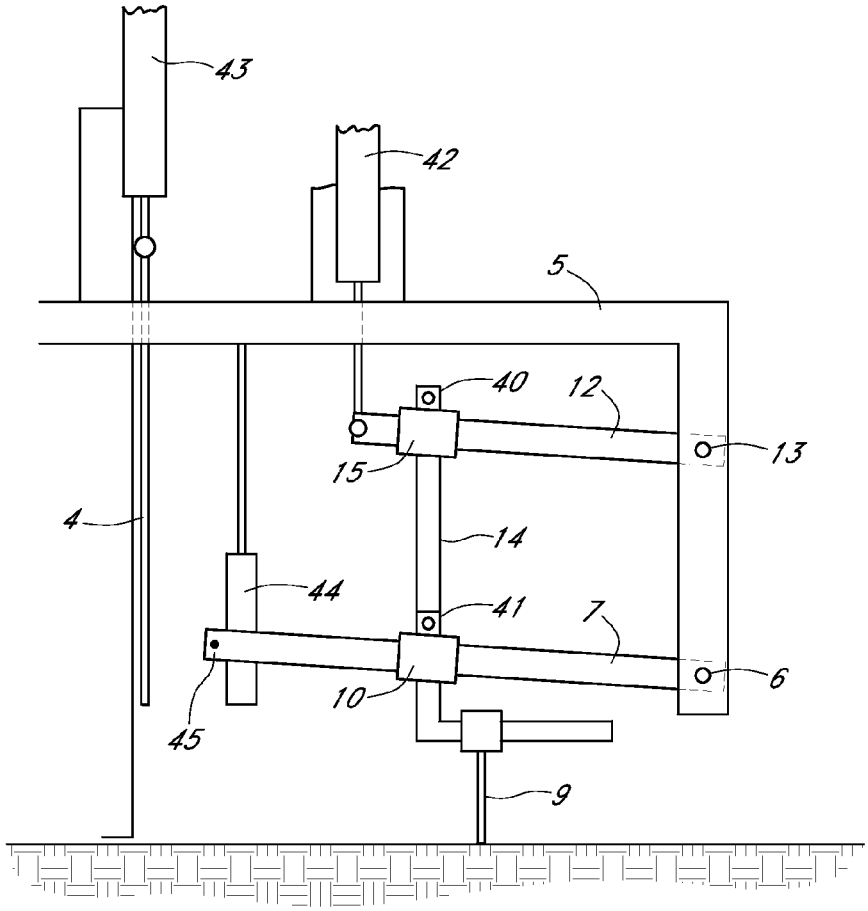
FIG. 12 is a purely schematic illustration of another possible embodiment.

FIG. 12 is a purely schematic illustration of another preferred embodiment where a blade 9 is suspended in a parallelogram arrangement comprising a supporting arm 5 where a parallel rod 12 is articulately supported at 13. The parallel rod 12 runs parallel with the rod 7, which is supported at 6. The blade 9 is attached to a rod 14 that is pivotally 40, 41 connected to a respective sleeve 10, 15 that can be moved along the rod 7 and the parallel rod 12 respectively and can be fixed there in the same way as discussed earlier. There is a parallelogram arrangement of this kind on each blade side (see, e.g., FIG. 3).

A working cylinder 42 is connected to the parallel rods 12 for raising and lowering the blade 9.

The two rods 7 are extended in the direction of the plate 4, which can be raised and lowered by a working cylinder 43.

Suspended from the supporting arms 5 is a control device 44 for activation of the movement of the working cylinders 43. The control device is actuated by a light beam 45 which passes between the two ends of the rods 7 facing the plate 4. The light beam 45 forms an indirect connection between the rods 7 and actuates the control device 44. If the light beam moves up, the control device 44 is actuated and causes the working cylinder 43 and the plate 4 to move up, and conversely, if the light beams 45 moves down, the plate 4 moves down in the set situation.

Figure 13:
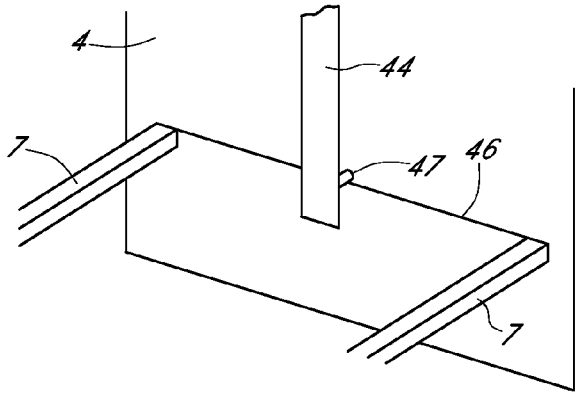
FIG. 13 is a purely schematic illustration of yet another possible solution.

FIG. 13 is a purely schematic illustration of how the rods 7, instead of having an indirect connection (the light beam 45), can be connected directly to an elastic band 46 which actuates a switch 47 in the box (the control device) 44.

The embodiments in FIGS. 12 and 13 can also be made as pure lever embodiments (as for example in FIG. 1).

The invention claimed is:

1. An apparatus for smoothing or leveling a mass of material, which is discharged from a box-like device, having an interior space for receiving said mass of material, the mass of material being caused to exit through an adjustable opening, to distribute the mass of material from the box-like device, when the box-like device is moved in a forward direction above the ground, such that the mass of material is caused to form a strip-like layer, on a surface, the apparatus comprising:

at least one blade member linked to the box-like device so as to be vertically adjustable and located downstream of the opening, wherein the thickness of the layer is adjustable by controllably raising or lowering said blade member; and an opening adjustment member, disposed adjacent the rear wall of said box-like device, which is movable upwardly and downwardly relative to a rear wall of the box-like device;

wherein the at least one blade member is linked to the upward or downward movable opening adjustment member so that raising or lowering of the at least one blade member is made in conjunction with adjustment of said rear opening to yield an adjustable reduction ratio relative to a positional state of the adjustable opening and the related position of the opening adjustment member, and wherein the at least one blade member upon movement of the box-like device in addition causes the material to be at least one of: spread, levelled and smoothed.

2. The apparatus of claim 1, wherein the height of the at least one blade member is detected by a laser levelling system, and wherein detected deviation from a set value is compensated by raising or lowering the opening adjustment member and thereby cause the at least one blade member to correspondingly adjust its level until the levelling system signals a desired blade member height.

3. The apparatus of claim 1, wherein the opening adjustment member is configured as a plate member.

4. The apparatus of claim 1, wherein the at least one blade member is configured as a plough.

5. An apparatus for smoothening or levelling a mass of material comprising:

a box-like device with an interior space, defined by two sidewalls, a front and rear wall, for receiving said mass of material, and an adjustable opening, disposed on said rear wall through which said mass of material exits the box-like device, to form a strip-like layer downstream of the adjustable opening; when the box-like device is moved in a forward direction above the ground;

an upwardly and downwardly movable opening adjustment member is provided at the rear wall of the device adjacent said opening in the box-like device, wherein an adjustable position of the opening adjustment member controls an amount of material exiting from the box-like device through the opening as the box-like device is moved forwards, at least one blade member located downstream of said opening, said at least one blade member being configured to be controllably raised or lowered, wherein the at least one blade member is mechanically linked to the opening adjustment member so as to be capable of being raised and lowered in conjunction with positional adjustment of the opening adjustment member, and wherein the at least one blade member is movable in an adjustable reduction ratio relative to the opening adjustment member when the opening adjustment member is caused to be raised or lowered.

6. The apparatus of claim 5, wherein said opening adjustment member is in the form a plate member.

7. The apparatus, of claim 5, wherein the at least one blade member is adjustably supported in a parallelogram arrangement, and wherein a lever and a supporting part for the blade member form non-parallel sides of the parallelogram arrangement.

8. The apparatus of claim 5, wherein a laser reflector of a laser levelling system is fixedly connected to the blade member.

9. The apparatus of claim 5, wherein two blade members are arranged downstream of the opening, said blade members being spaced from each other in the downstream direction.

10. The apparatus of claim 5, wherein a material compactor device is mounted downstream of the blade member.

11. The apparatus of claim 9, wherein a material compactor is mounted in a space between said two blade members.

12. The apparatus of claim 5, wherein the at least one blade member is configured to have its position angled in a horizontal plane relative to a direction of movement of the box-like device.

13. The apparatus of claim 12, wherein said blade member is set to act as a plough.

14. The apparatus of claim 5, wherein the blade member is included in a blade assembly, wherein the blade assembly defines a fixed frame which has a plurality of arms pivotally attached thereto, wherein a first set of arms of said plurality of arms extend at least from the fixed frame to a first set of blade member supports, wherein a second set of arms of said plurality of arms at one end thereof are linked to the adjustable opening member, wherein the second set of arms adjustably engage a second set of blade member supports, and wherein said second set of arms are telescoping so as to accommodate different lengths based upon a controllable position of the opening adjustment member relative to the fixed frame.

15. The apparatus of claim 5, wherein the blade member is included in a blade assembly, wherein the blade assembly defines a fixed frame which has a plurality of arms pivotally attached thereto, wherein said plurality of arms adjustably engage a set of blade member supports, and wherein said plurality of arms at one end thereof are linked to the adjustable opening member and are telescoping so as to accommodate different lengths based upon a controllable position of the opening adjustment member relative to the fixed frame.

16. An apparatus for smoothening or levelling a mass of material which is discharged from a box-like device configured to receive said mass of material and to dispose and spread the mass of material onto a ground related surface, through an adjustable opening of the box-like device to subsequently come to lie in a strip-like layer downstream of the opening, when said apparatus is moved in said first direction said a box-like device having two side walls, a front wall and a rear end wall defining said interior space, the apparatus comprising:

an opening adjustment member movably mounted to the box-like device so as to define an adjustable opening in the box-like device, wherein the opening adjustment member is downwardly and upwardly movable so as to adjust the opening and allow a varying degree of material to be distributed from the box-like device via the opening, a movable blade assembly is mounted downstream of the opening, said assembly including at least one blade member, and wherein the assembly is linked to the movable opening adjustment member such that said at least one blade member can be raised or lowered in conjunction with movement of the opening adjustment member, and wherein the at least one blade member is movable in an adjustable reduction ratio relative to the opening adjustment member when the opening adjustment member is caused to be raised or lowered.

17. The apparatus of claim 16, wherein the opening adjustment member is configured like a plate member.

18. The apparatus of claim 17, wherein the movable blade assembly comprises a plurality of arms that extend outward from the plate member, and wherein at least one blade member is attached to the arms.

19. The apparatus of claim 18, wherein the plurality of arms comprises a first set of parallel arms that extend outward from the movable plate member, and wherein the at least one blade member is positioned so as to depend from said first set of parallel arms.

20. The apparatus of claim 19, wherein the plurality of arms includes a second set of arms parallel to and vertically displaced from the first set arms, and wherein the at least one blade member is in releasable attachment with both the first and second set of arms.

21. The apparatus of claim 17, wherein the blade assembly defines a fixed frame with a first set of arms of plurality of arms being pivotally attached thereto so as to extend from the blade member to the fixed frame, and wherein a second set of arms of the plurality of arms at one end thereof are pivotally attached to the fixed frame and at the other end linked to the plate member, said second set of arms being telescoping so as to accommodate different lengths based upon a controlled position of the plate member relative to the fixed frame.

22. The apparatus of claim 17, wherein the blade assembly defines a fixed frame with a first set of arms being pivotally attached thereto so as to extend from the plate member to the fixed frame, and wherein said set of arms at one end thereof are pivotally attached to the fixed frame and at the other end linked to the plate member, said set of arms being telescoping so as to accommodate different lengths based upon a controlled position of the plate member relative to the fixed frame.

23. The apparatus of claim 18, wherein the at least one blade member is movable along the length of the plurality of arms so as to allow for adjustment of the height of the blade member relative to the material dispensed from the opening of the box-like device.

24. The apparatus of claim 16, wherein the movable blade assembly comprises a plurality of blades.

25. The apparatus of claim 16, wherein the blade assembly includes working cylinders with pistons that cause movement of the arms of the blade assembly and the at least one blade member up and down.

26. The apparatus of claim 25, wherein the pistons are linked to the arms so as to allow the blade member to be tilted to one side or another.

27. An apparatus for discharging a mass of material onto a ground related surface and for subsequent smoothing or levelling of the discharged material, the apparatus comprising:

a box-like device having side walls, a front wall and a rear wall that define an interior space which is configured to receive an amount of material to be discharged, wherein the rear wall of the box-like device defines an opening through which material from the interior space of the box can be distributed to the surface as the box-like device is moved in a first direction;

an opening adjustment member which is in the form of plate member and mounted to the box-like device so as to define the opening in the box-like device, wherein the plate member is movable up or down so as to adjust the opening and allow a varying degree of material to be distributed from the box-like device via the opening;

a movable blade assembly mounted downstream of the opening and that includes at least one blade member, wherein the assembly is coupled to the plate member such that at least one blade member can be raised or lowered in conjunction with and in an adjustable reduction ratio relative to the plate member as the plate member is raised or lowered, the movable blade assembly comprising a plurality of arms that extend from the plate member, and wherein the at least one blade member is attached to the arms; and the at least one blade member being movable along the length of the plurality of arms so as to allow for adjustment of the height of the blade member from the material discharged from the box-like device.

28. The apparatus of claim 27, wherein the plurality of arms comprises a first set of parallel arms that extend outward from the movable plate member and wherein the blade member is positioned so as to depend from the two parallel arms.

29. The apparatus of claim 27, wherein the plurality of arms includes a second set of arms parallel to and vertically displaced from the first set arms, and wherein the at least one blade member is attached to both the first and second set of arms.

30. The apparatus of claim 27, wherein the blade assembly defines a fixed frame with plurality of arms being pivotally attached thereto so as to extend from the plate member to the fixed frame, and wherein the plurality of arms are telescoping so as to accommodate different lengths based upon the respective position of the plate member and the fixed frame.

31. The apparatus of claim 27, the movable blade assembly comprises a plurality of blade members.

32. The apparatus of claim 27, wherein the blade assembly includes pistons that move the arms of the blade assembly and the at least one blade member up and down.

33. The apparatus of claim 27, wherein the pistons are coupled to the arms so as to allow the at least one blade member to be tilted to one side or another.

34. The apparatus of claim 27, wherein two blade members are provided, and wherein a material compactor device is mounted at a location between said two blade members.

* * * * *

UNITED STATES PATENT AND TRADEMARK OFFICE

CERTIFICATE OF CORRECTION

PATENT NO. : 7,182,549 B2
APPLICATION NO. : 10/490800
DATED : February 27, 2007
INVENTOR(S) : Omar Wiker It is certified that error appears in the above-identified patent and that said Letters Patent is hereby corrected as shown below:

On the Title Page, Item [56] please add the priority information as follows: --Norway 200114763 10/01/2001;--

On the Title Page (Title), please delete "LEVELING" and replace with --LEVELLING--, therefor;

On Column 1, Line 1 (Title), please delete "LEVELING" and replace with --LEVELLING--, therefor;

On Column 7, Line 11, Claims 6, after "form" please insert --of--.

Signed and Sealed this

Second Day of October, 2007

JON W. DUDAS
*Director of the United States Patent and Trademark Office*